US006580894B1

(12) United States Patent
Kobashigawa

(10) Patent No.: US 6,580,894 B1
(45) Date of Patent: Jun. 17, 2003

(54) FIXING APPARATUS

(75) Inventor: Kei Kobashigawa, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/083,753

(22) Filed: Feb. 25, 2002

(51) Int. Cl.[7] ..... G03G 15/20
(52) U.S. Cl. ..... 399/329; 219/216
(58) Field of Search ..... 219/216; 399/328, 399/329, 330, 331, 333

(56) References Cited

U.S. PATENT DOCUMENTS 6,282,398 B1 * 8/2001 Higashi ..... 399/329
6,321,061 B1 * 11/2001 Sonobe et al. ..... 399/329

FOREIGN PATENT DOCUMENTS

JP 05-072931 A 3/1993
JP 08-115003 A 5/1996

* cited by examiner

*Primary Examiner*—Hoang Ngo
(74) *Attorney, Agent, or Firm*—Frishauf, Holtz, Goodman & Chick, P.C.

(57) ABSTRACT

A fixing apparatus according to the present invention includes a heating member, a belt support member, a heating belt, a press member, a first control section, and a second control section. The belt support member has a cylindrical shape partly cut out along an axis line direction and is capable of changing the size of the cross section area. The first control section controls the size of the cross section area of the belt support member. The second control section applies a force to the heating belt toward the press member and controls that magnitude.

8 Claims, 8 Drawing Sheets

FIXING APPARATUS

BACKGROUND OF THE INVENTION

The present invention relates to a fixing apparatus in an image forming apparatus.

An image forming apparatus employing electrophotography is provided with a fixing apparatus for fixing a toner image formed on a printout material. Some types of fixing apparatuses use a heating belt. Such a fixing apparatus comprises a heating roller, a belt support roller, a heating belt, and a press roller. The belt support roller is made of an elastic material. The heating belt is supported by the heating roller and the belt support roller, and is rotated by rotations of both rollers. The heating roller heats the heating belt. The press roller is rotated by pressing against and contact with a portion supported by the belt support roller in the heating belt. Recording paper is fed by a contact area between the heating belt and the press roller. A toner image is pressurized and heated, and is fixed onto the recording paper.

The belt support roller is deformed due to elasticity along a peripheral direction of the press roller and can allow the heating belt having a large width to contact the press roller. Accordingly, it is possible to enlarge the width of the contact area between the heating belt and the press roller, and to fix toner images by transporting the recording paper sandwiched between wide areas.

However, the conventional fixing apparatus always contacts the heating belt, i.e., the belt support roller under a constant pressure. When there is a wide contact area between the heating belt and the press roller, a contact pressure is decreased at the contact area per unit area. When the recording paper is thick, the contact area between the heating belt and the press roller cannot generate a high enough pressure to press the recording paper, then that pressure gives an unfavorable effect on fixing. The width of the contact area between the heating belt and the press roller may vary with aging of materials. When the contact area width varies, a fixing condition of toner images are changed by varying the contact pressure per unit area on the contact area.

Accordingly, it is requested to change the width and the contact pressure of the contact area between the heating belt and the press roller according to various conditions.

Conventionally, there are offered proposals for solving this problem. One proposal is disclosed in Jpn. Pat. Appln. KOKAI Publication No. 5-72931. The fixing apparatus uses a roller attached to a rotative lever to support the heating belt. A solenoid rotates the rotative lever to displace the roller. The heating belt changes the condition of contact with the press roller.

When a change occurs in the condition of contact between the heating belt and the press roller on the fixing apparatus, however, the height position of the contact area varies in a vertical direction. As the conditions of conveying recording paper are changed the conveying may stop or the fixing conditions of toner images may be changed.

Another proposal is disclosed in Jpn. Pat. Appln. KOKAI Publication No. 8-115003. In the fixing apparatus, recording paper is placed on a guide plate. A cylindrical heating belt rotates in contact with the recording paper. As the guide plate is displaced by a pressing means, the condition of contact between the heating belt and the guide plate is changed.

When a change occurs in the condition of contact between the heating belt and the guide plate on the fixing apparatus, however, the height position of the contact area varies in a vertical direction. Since conditions of conveying for recording paper is changed the conveyance may stop and fixing condition of toner images may be changed.

BRIEF SUMMARY OF THE INVENTION

It is an object of the present invention to provide a fixing apparatus for solving the conventional problems.

A fixing apparatus according to an aspect of the present invention comprises: a heating member which rotates around an axis; a belt support member which is heat-resistant and elastic, has a cylindrical shape partly cut out along an axis line direction, and is capable of varying the size of a cross section area; an endless heating belt which rotates by being supported by the heating member and the belt support member, and slidingly contacts the belt support member; a press member which conveys the printout material by cooperating with part of the heating belt supported by the belt support member putting the printout material between them; a first control section which supports the belt support member and controls the size of the cross section area thereof; and a second control section which applies a force to the heating belt toward the press member and controls that magnitude.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will be described in further detail with reference to the accompanying drawings.

Figure 1:
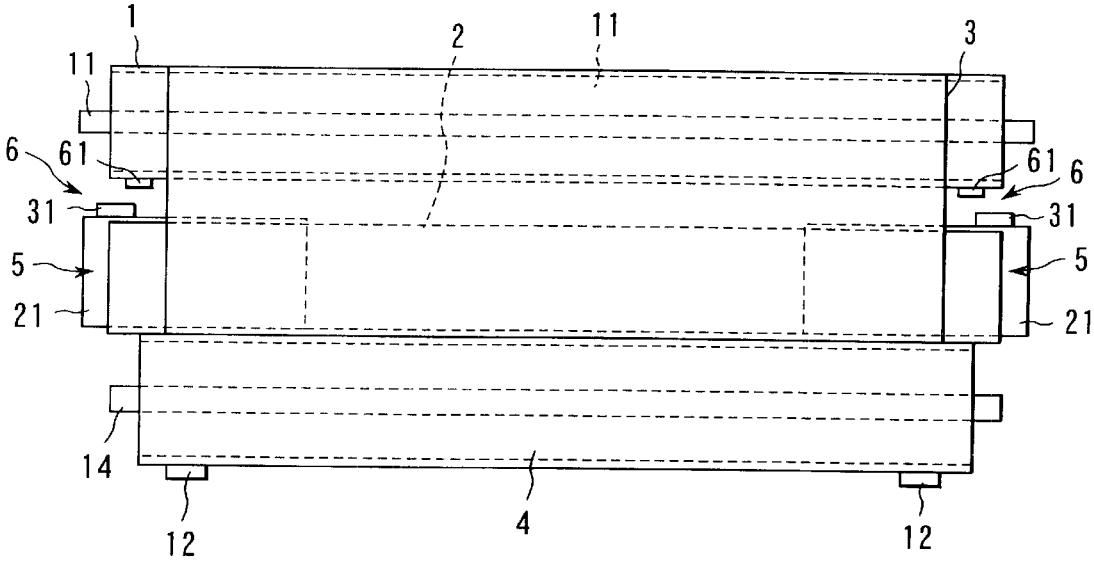
FIG. 1 is a front view schematically showing a fixing apparatus according to an embodiment of the present invention.
Figure 2:
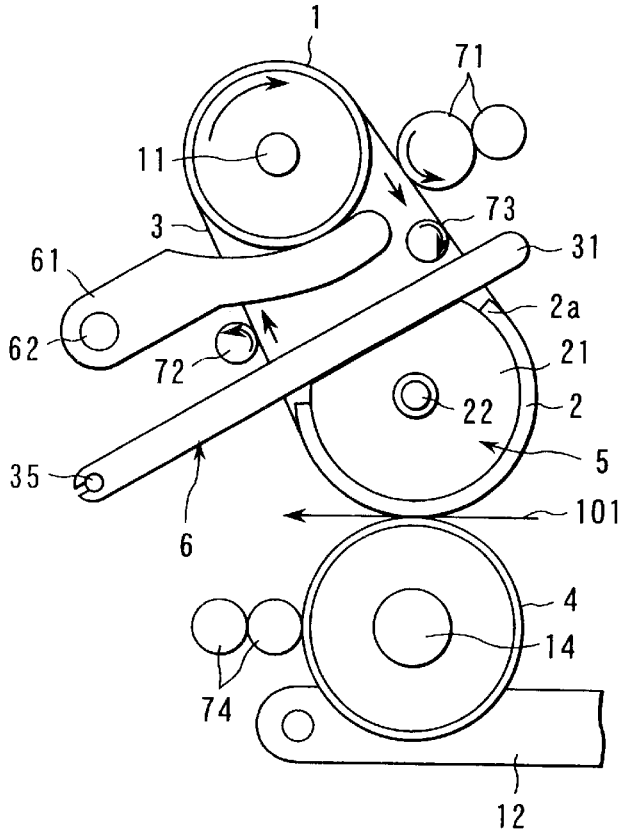
FIG. 2 is a side view schematically showing the fixing apparatus according to the embodiment.

FIG. 1 is a front view showing a fixing apparatus according to an embodiment of the present invention. FIG. 2 is a side view thereof. The fixing apparatus is installed in an image forming apparatus applying electrophotography, and fixes a toner image formed on recording paper 101 as an example of printout materials. The fixing apparatus comprises a heating roller 1, a belt support member 2, a heating belt 3, a press roller 4, a first control section 5, and a second control section 6.

The heating roller 1 is an example of a heating member. The heating roller 1 is shaped cylindrically and longer than the width of the recording paper 101. The heating roller 1 is arranged horizontally along a direction orthogonal to a conveying direction of the recording paper 101. Both ends of the heating roller 1 are supported by a support member 61 rotatably on a shaft. The heating roller 1 is rotated by a drive mechanism (not shown). A heater 11 is inserted into the heating roller 1.

The belt support member 2 is formed of a heat-resistant and elastic material, e.g., polyacetal. The belt support member 2 is cylindrical partially cut out along axially. For example, the belt support member 2 is semicylindrical and is longer than the width of the recording paper 101. A cross section of the belt support member 2 forms a semicircle (arc) by cutting to break the top of a circle. A broken part 2*a* continues overall along the shaft direction. Since the cross section deforms due to elasticity of the belt support member 2 itself, the belt support member 2 is possible to change sizes of the cross section area and the arc curvature. The semicircular cross section of the belt support member 2 increases its area and decreases the arc curvature, i.e., increases the radius of curvature, as the broken part 2*a* widens. The cross section of the belt support member 2 decreases its area and enlarges the arc curvature, i.e., decreases the curvature radius, as the broken part 2*a* narrows.

The belt support member 2 is arranged under the heating roller 1 parallel thereto. Both ends of the belt support member 2 each are supported by a control member 21 (to be described) to maintain the semicylindrical shape.

The heating belt 3 is formed of a heat-resistant and heat-conductive material such as polyimide. The heating belt 3 is endless and has a width larger than the width of the recording paper 101 and has a circumferential length capable of putting it around the heating roller 1 and the belt support member 2. The heating belt 3 is provided rotatably by putting around the heating roller 1 and the belt support member 2. In other words, one corner of the heating belt 3 is supported in contact with an outer periphery of the heating roller 1. The other corner thereof is supported in contact with an outer periphery of the belt support member 2. Accordingly, slippery and abrasion-resistant materials are selected for the heating belt 3 and the belt support member 2.

The press roller 4 is cylindrical and has a length larger than the width of the recording paper 101. The press roller 4 is horizontally arranged under the belt support member 2 parallel thereto. Both ends of the press roller 4 each are rotatably supported by a cradle member 12. The pair of support members 12 sustains the press roller 4 at its bottom and supports the press roller 4 by maintaining it at a given height. The top of the peripheral surface of the press roller 4 touches the heating belt 3 supported by the peripheral surface of the belt support member 2 from the bottom side. The press roller 4 is rotated by, e.g., a drive mechanism (not shown). A gear 13 is provided at the end of the press roller 4 and is assembled in the drive mechanism. The rotation of the heating belt 3 may make the press roller 4 drive to rotate. A heater 14 is provided inside the press roller 4.

Figure 7:
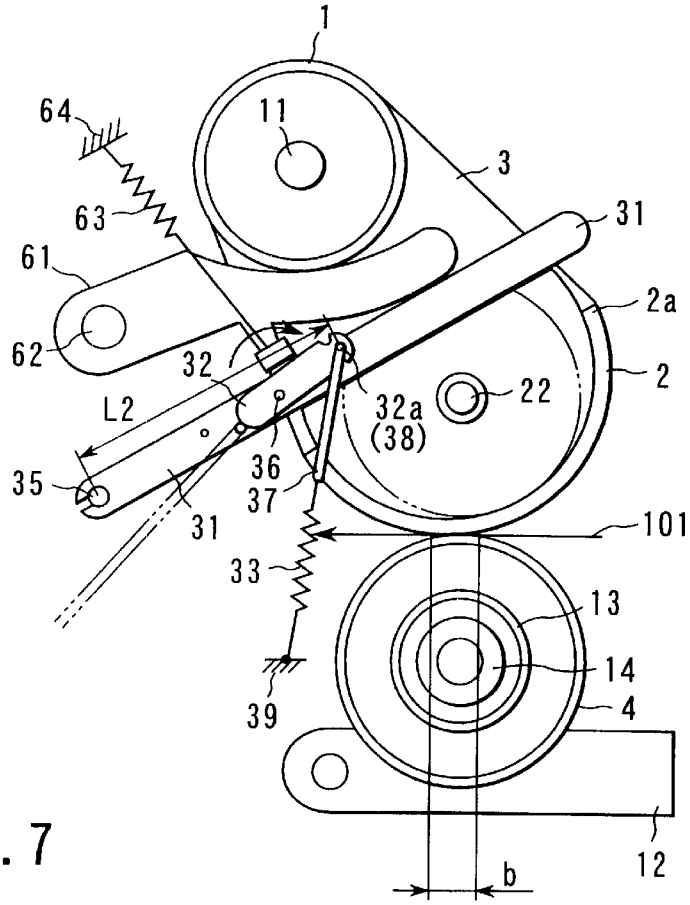
FIG. 7 is a side view showing a state of contact between the heating belt and the press roller in the fixing apparatus according to the embodiment.
Figure 8:
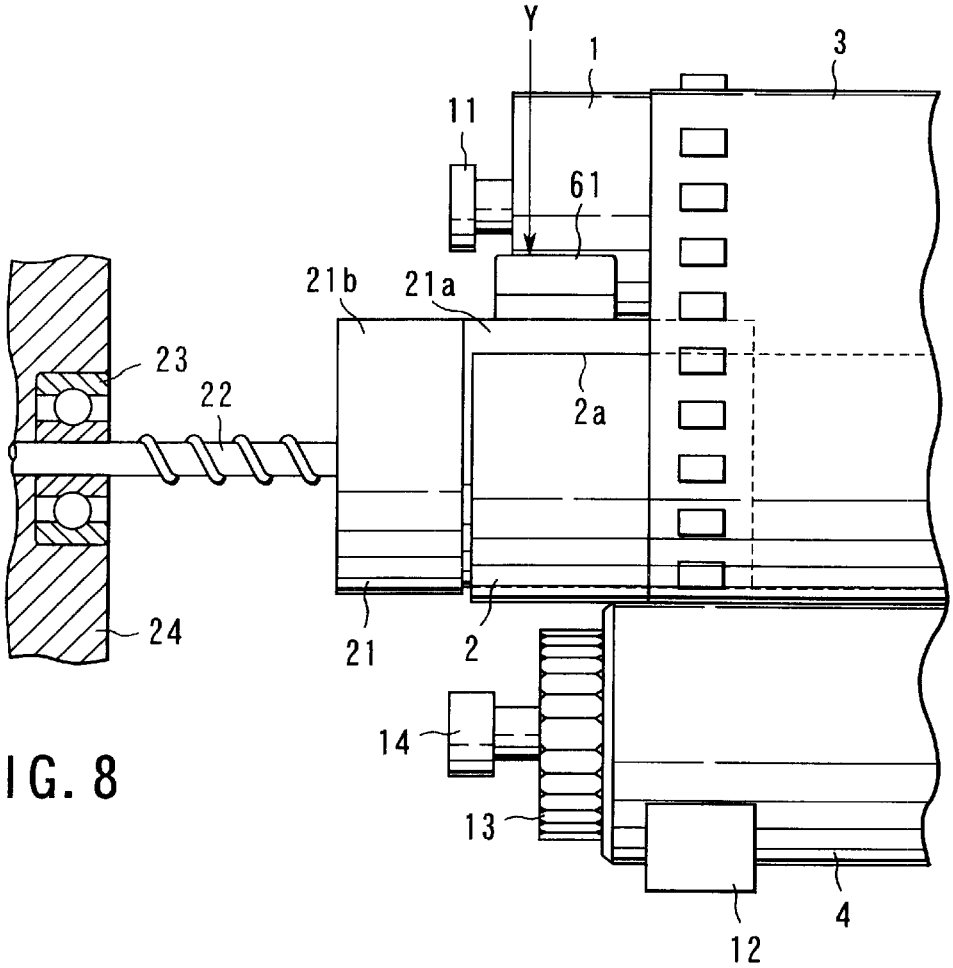
FIG. 8 is a front view showing a state of contact between the heating belt and the press roller in the fixing apparatus according to the embodiment.
Figure 9:
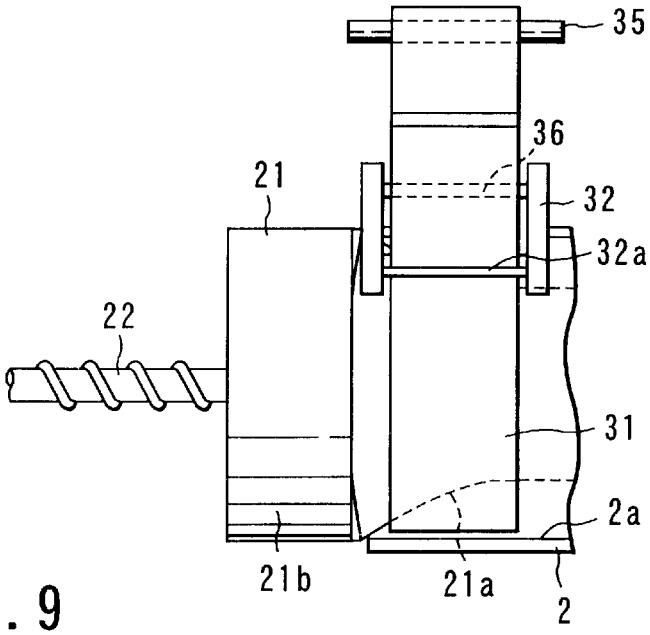
FIG. 9 shows a portion viewed from direction Y in FIG. 8.

The first control section 5 will now be described with reference to FIGS. 3 through 9. As shown in FIG. 1, the first control section 5 is provided at each end of the belt support member 2. Two sets of the first control section 5 are provided in total. FIGS. 3 through 6 show one end of the belt support member 2, wherein there is a small contact area between the belt support member and the press roller. FIGS. 7 through 9 show one end of the belt support member 2, wherein there is a large contact area between the belt support member 2 and the heating belt 3 (press roller 4).

One first control section 5 is used as an example for explanation. The first control section 5 supports the belt support member 2 and changes the cross section area size of the belt support member 2. The first control section 5 has the control member 21.

The control member 21 is a sideways long block. The control area 21*a* is the portion between one end and the other end. The other end is a stopper 21*b*. The cross section of the control area 21*a* is drawn around the center axis line of the control member 21 and forms a semicircle having a flat surface at its top along the diameter direction. The semicircular cross section area continuously increases from one end of the control member 21 to the stopper 21*b*. Namely, the arc forming the semicircular cross section continuously increases the radius of curvature and continuously decreasing the curvature from one end of the control member 21 to the stopper 21*b*.

The control area 21*a* is inserted into the belt support member 2 from the end along the axis line and form a semicircular cross section of the belt support member 2. Due to elasticity, the belt support member 2 tightly contacts the peripheral surface of the control area 21*a* and opens the top. Thus the cross section forms a semicircular shape. Additionally, the control member 21 widens the belt support member 2 due to its elasticity. As a consequence, the belt support member 2 is tightly fixed to the outer surface of the control member 21.

The cross section of the control area 21*a* determines sizes of the semicircular cross section and the curvature of the belt support member 2. The cross section form of the belt support member 2 depends on the semicircular cross section area and the curvature of the control area 21*a* at the open end of the belt support member 2.

With the control area 21*a* inserted into the belt support member 2, the control member 21 is arranged horizontally and is movably supported by a member (not shown). A feed screw 22 is screwed into the control member 21 along the axis line. The feed screw 22 is supported by a bearing 23 and is rotated by the drive mechanism (not shown). The control member 21 moves inwardly and outwardly for the belt support member 2 along the axis line by rotating the feed screw 22.

Figure 10:
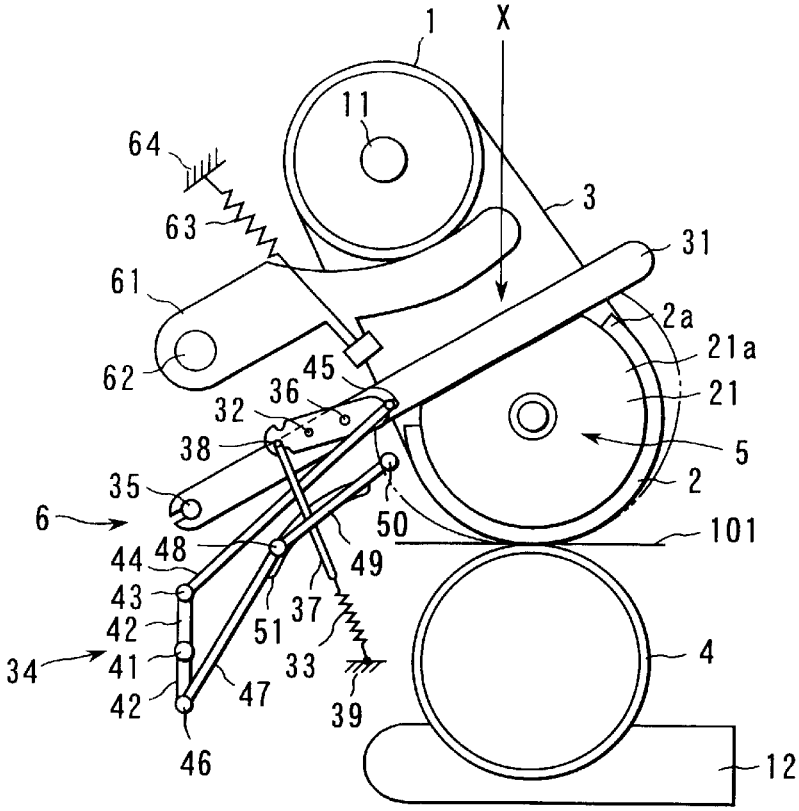
FIG. 10 is a side view showing operations of a control section in the fixing apparatus according to the embodiment.
Figure 11:
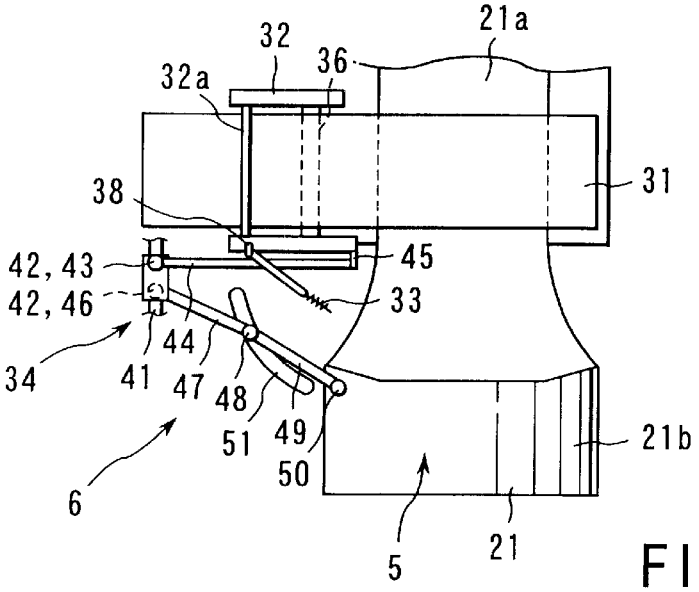
FIG. 11 shows a portion viewed from direction X in FIG. 10.
Figure 12:
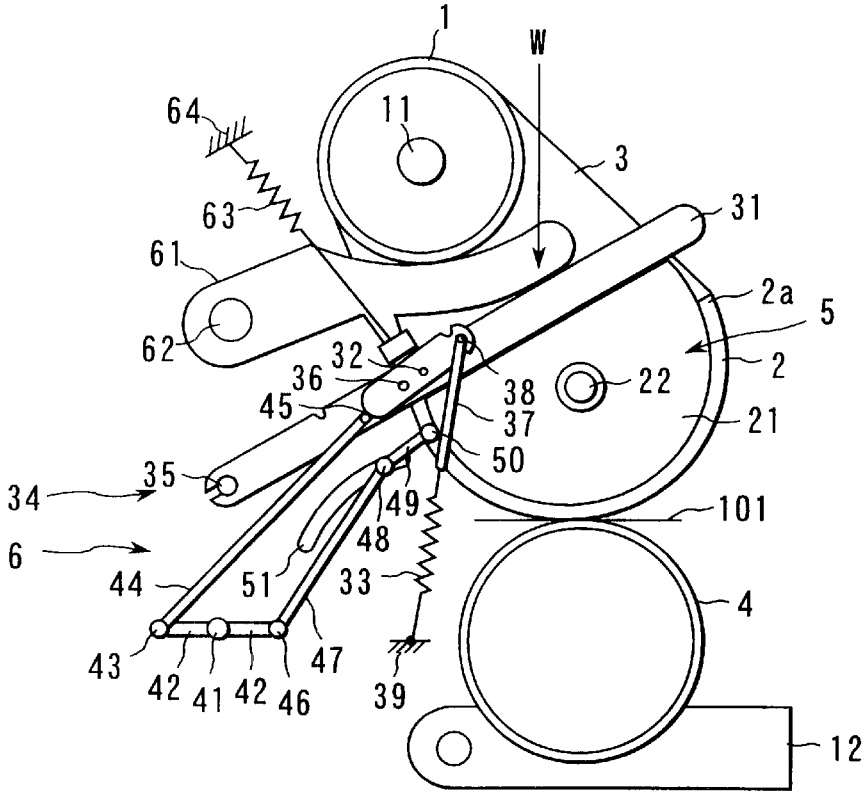
FIG. 12 is a side view showing operations of a control section in the fixing apparatus according to the embodiment.
Figure 13:
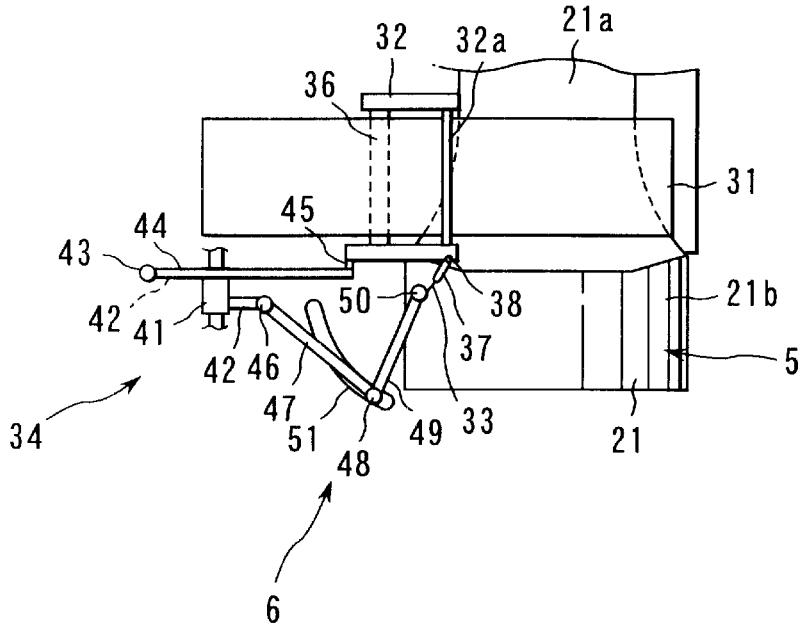
FIG. 13 shows a portion viewed from direction W in FIG. 12.

The second control section 6 will be described with reference to FIGS. 10 through 13. As shown in FIG. 1, the second control section 6 is provided at each end of the belt support member 2. Two sets of the second.control section 6 are provided in total. FIGS. 10 and 11 show one end of the belt support member 2, wherein there is a small contact area between the belt support member and the press roller. FIGS. 12 and 13 show one end of the belt support member 2 of the fixing apparatus, wherein there is a large contact area between the belt support member 2 and the heating belt 3 (press roller 4).

One second control section 6 is used as an example for explanation. The second control section 6 applies a force to the heating belt toward the press roller via the belt support member 2 and controls the force. The second control section 6 comprises a pressing member 31, an acting member 32, an elastic member 33, and a linkage 34.

The pressing member 31 is shaped like a lever and is positioned to the top of the belt support member 2 along the diameter direction. The pressing member 31 is rotatably and vertically supported by a pivot shaft 35 at one end and touches the top, flat surface of the control member 21. The pressing member 31 is longer than the diameter of the control member 21. The acting member 32 is so shaped as to straddle over the top surface of the pressing member 31. One end of the acting member 32 has an acting shaft 32*a* facing toward the top surface of the pressing member 31. A shaft 36 rotatably supports the middle of the side positioned at both sides of the pressing member 31. The shaft 36 is inserted into the pressing member 31 on the same plane as the central axis of the belt support member 2. Accordingly, the acting member 32 can rotatively move on the shaft 36 between a position far from the pivot shaft 35 and a position near thereto. When the acting member 32 rotatively moves on the shaft 36 between a position far from the pivot shaft 35 and a position near thereto, the acting shaft 32*a* stops the rotational movement by touching the top surface of the pressing member 31.

A link 37 is rotatably connected to one end of the acting member 32 via ball joints 38 at the side of the acting shaft 32*a*. The link 37 is connected to the elastic member 33. In the embodiment, a helical tension spring is used as the elastic member 33 and is fixed to a proper member 39. The elastic member 33 applies a force to the pressing member 31 toward the control member 21 via the acting member 32.

The linkage 34 rotatively moves the acting member 32 in accordance with the movement of the control member 21. The linkage 34 includes a pivot shaft 41, a link 42, and a link 44. The pivot shaft 41 is provided parallel to the belt support member 2. The link 42 rotatively moves on the pivot shaft 41. The link 44 is connected to one end of the link 42 via a ball joint 43. The link 44 is connected to the other end of the acting member 32 via a ball joint 45. The linkage 34 further includes a link 47 and a link 49. The link 47 is connected to the other end of the link 42 via ball a joint 46. The link 49 is connected to the link 47 via a ball joint 48. The link 49 is connected to a stopper 21*b* of the control member 21 via a ball joint 50. The ball joint 48 is movably inserted into a guide groove 51 which is formed in a member (not shown). The guide groove 51 is used for converting movement of the control member 21 along the axis line to rotational movement of the pivot shaft 41. The guide groove 51 is formed three-dimensionally as shown in FIGS. 10, 12, 11, and 13.

Each of the ball joints 38, 43, 45, 46, 48, and 50 has a ball and a cover. The ball is attached to one member (e. g., a link). The cover is attached to another member (e. g., another link). As the cover encloses the ball, the cover and the ball are jointed semi-omnidirectional and rotatably. Namely, the ball joint connects both members to each other almost nondirectionaly and rotatably.

As shown in FIG. 1, the lever-shaped support member 61 rotatably supports both ends of the heating roller 1. The support members 61 are arranged along the diameter direction of the heating roller 1 thereunder. The support members 61 can move rotatively up and down by means of the pivot shaft 62 provided parallel to the heating roller 1. An elastic member 63 applies an upward force (toward the heating roller 1) to the support members 61. Therefore, the support members 61 are pressed to touch the bottom surface of the heating roller 1. The force of the elastic member 63 is smaller than that of the elastic member 33. The support member 63 supports the heating roller 1 and applies a tensile force to the heating belt 3 via the heating roller 1.

The heating roller 1 and the belt support member 2 are supported in this manner. The heating belt 3 is kept around the heating roller 1 and the belt support member 2 freely rotatably.

A releasant roller 71 touches the outer surface of the heating belt 3. The releasant roller 71 rotates and applies releasing agent to the heating belt 3 when the heating belt 3 rotates. The releasing agent prevents the toner for the recording paper 101 from sticking on the heating belt 3, during fixing operation. The cleaning roller 72 touches the outer surface of the heating belt 3. The cleaning roller 72 cleans the outer surface of the heating belt 3 during fixing by rotating. A lubricant roller 73 touches an inner surface of the heating belt 3. The lubricant roller 73 applies lubricant to the heating belt 3 during fixing by rotating. The lubricant makes smooth a contact area between the inner surface of the heating belt 3 and the outer surface of the belt support member 2. A cleaning roller 74 touches the press roller 4. The cleaning roller 74 cleans the surface of the press roller 4 during fixing by rotating.

Operations of the fixing apparatus will now be described hereinafter.

In each first control section 5, the control members 21 support the belt support member 2 at both ends and form the cross section of the belt support member 2. The belt support member 2 is arranged above the press roller 4. The heating belt 3 supported by the belt support member 2 touches the upper peripheral surface of the press roller 4. The press roller 4 is supported and maintained at a given height position by each cradle member 12 and is pressed by force applied to the control member 21.

In each second control section 6, the acting shaft 32*a* touches the top surface of the pressing member 31, as the elastic member 33 pulls the acting member 32. The pressing member 31 presses the top surface of the control member 21 as applying a downward force thereto by being pushed by the acting member 32. The downward force of the pressing member 31 acts on the belt support member 2 and the heating belt 3 via the control member 21. Thus, the heating belt 3 is pressed and touches the peripheral surface of the press roller 4.

Since the heating belt 3 is pulled by the control member 21 downward, the heating belt 3 applies a downward force to the heating roller 1. The support member 61 bears the force of the heating belt 3 by means of the force of the elastic member 63 and rotatably support the heating roller 1.

The heater 11 heats the heating roller 1. The heating roller 1 then heats the heating belt 3. When the heating roller 1 rotates in the direction of the arrow in the figure, a moving force is applied to part of the heating belt 3 supported by the heating roller 1. Thus, the heating belt 3 rotates in the direction of the arrow in the figure. The belt support member 2 is fixed by means of elasticity of the control member 21 and is kept motionless if the heating belt 3 rotates. Therefore, the heating belt 3 slippery touches and passes the outer surface of the belt support member 2. In other words, the belt support member 2 works as a sliding bearing for the heating belt 3. The press roller 4 rotates in the direction of the arrow in the figure and is heated by the heater 14. A toner image is formed on the recording paper 101. The recording paper 101 is conveyed from the right of the fixing apparatus in the figure with the toner image on the top surface of the paper. The recording paper 101 enters the contact area between the heating belt 3 and the press roller 4 which are rotating, then passes the contact area for subsequent conbeyance. At this time, the toner image is fixed to the recording paper 101 by being heated and pressed by the heating belt 3 and the press roller 4.

The first control section 5 provides control to change the size of the width for the heating belt 3 to contact the press roller 4. The semicircular cross section area is formed by the control area 21*a* of the control member 21 continuously increases from one end of the control member 21 to the stopper 21*b*, thus the radius of curvature continuously increases, and the curvature continuously decreases. Therefore, the cross section area and the curvature of the control area 21*a* combined with belt support member 2 when the control member 21 is moved in or out of the belt support member 2 along the axis line direction. The peripheral length of the belt support member 2 contacting the control area 21*a* is determined according to the cross section area and the curvature of the control area 21*a*. In other words, the peripheral length of the heating belt 3 contacting the belt support member 2 is determined. Further, the contacting width (circumferential length) between the heating belt 3 and the press roller 4 is determined.

When the control member 21 is pulled out of the belt support member 2 for a large length, the control area 21*a* combined with the belt support member 2 has a semicircular cross section with a small area and a large curvature. Therefore, the belt support member 2 contacting the control area 21*a* has a small peripheral length, and the heating belt 3 contacting the belt support member 2 has a small peripheral length. Accordingly, the heating belt 3 contacts the press roller 4 with a small width. FIGS. 3, 4, 6, 10, and 11 show the states as above-mentioned. The reference symbol "a" in FIG. 3 denotes the width of the contact area between the heating belt 3 and the press roller 4.

When the control member 21 is pulled out of the belt support member 2 for a small length, the control area 21*a* combined with the belt support member 2 has a semicircular cross section with a large area and a large curvature. Therefore, the belt support member 2 contacting the control area 21*a* has a large peripheral length, and the heating belt 3 contacting the belt support member 2 has a large peripheral length. Accordingly, the heating belt 3 contacts the press roller 4 with a large width. FIGS. 7 through 9, 12, and 13 show the states as above-mentioned. The reference symbol "b" in FIG. 7 denotes the width of contact between the heating belt 3 and the press roller 4.

As mentioned above, an operation of the first control section 5 can vary the width of contact between the heating belt 3 and the press roller 4. Normally, a specified value is given to the width of contact between the heating belt 3 and the press roller 4 in consideration of the type of recording paper to be used and operational environment. The width of contact between the heating belt 3 and the press roller 4 is changed according to a difference in the type of recording paper and the operational environment. For example, a portion contacting the recording paper may not be heated fully. In such a case, the width of contact between the heating belt 3 and the press roller 4 is enlarged. Therefore the recording paper can be heated sufficiently by increasing a heating area for the recording paper. Alternatively, the heater may be subject to an unstable surface temperature at startup or a printout standby state in which the reserved standby temperature needs to be raised to a predetermined temperature. In such a case, the recording paper can be also heated sufficiently by properly changing the width of contact between the heating belt 3 and the press roller 4.

The second control section 6 provides control to change a force for the heating belt 3 to contact the press roller 4. The elastic member 33 acts on the pressing member 31 via the acting member 32. The pressing member 31 acts on the control member 21. The control member 21 acts on the heating belt 3 via the belt support member 2 and makes the heating belt 3 contact with the press roller 4. The magnitude of a force applied to the pressing member 31 by the elastic member 33 is determined by a distance between the pivot shaft 35 of the pressing member 31 and a working point for the elastic member 33 acting on the pressing member 31. The magnitude of the contact pressure per unit area at the contact area between the heating belt 3 and the press roller 4 is determined by the working point of the elastic member 33 and the width of that contact area.

The linkage 34 can be used to change the working point for the elastic member 33 to act on the pressing member 31. The working point is the position where the acting member 32 pushes the pressing member 31. The linkage 34 changes the working point for the elastic member 33 between two places according to the position of the control member 21 against the belt support member 2. The linkage 34 rotatively moves the link 42, because the link 49 is moved according to the position of the control member 21, and the link 47 connected to the link 49 is moved and guided along the guide groove 51. As rotative movement of the link 42 moves the link 44, the acting member 32 is rotatively moved. The acting member 32 rotatively moves around the shaft 36 and displaces the link 37 connected to the elastic member 33. The acting shaft 32*a* of the acting member 32 acts a force on the elastic member 33 by touching the top surface of the pressing member 31.

FIGS. 10 and 11 show that the working point for the elastic member 33 is located near the pivot shaft 35 of the pressing member 31. The acting member 32 rotatively moves around the shaft 36 so that the acting shaft 32*a* approaches the pivot shaft 35. The reference symbol "L1" in FIG. 3 denotes a distance between the pivot shaft 35 and the acting shaft 32*a*. The contact pressure per unit area at the contact area between the heating belt 3 and the press roller 4 is determined by the width "a" of the contact area and the distance "L1" between the pivot shaft 35 and the acting shaft 32*a*.

FIGS. 12 and 13 show that the working point for the elastic member 33 is located far from the pivot shaft 35 of the pressing member 31. The acting member 32 rotatively-moves around the shaft 36 so that the acting shaft 32*a* leaves the pivot shaft 35. The reference symbol "L2" in FIG. 7 denotes a distance between the pivot shaft 3.5 and the acting shaft 32*a*. The distance "L2" is larger than the distance "L1". The contact pressure per unit area at the contact area between the heating belt 3 and the press roller 4 is determined by the width "b" of the contact area and the distance "L2" between the pivot shaft 35 and the acting shaft 32*a*. Consequently, the distance "L2" between the pivot shaft 35 and the acting shaft 32*a* causes a greater contact pressure per unit area at that contact area than the distance "L1" therebetween.

As mentioned above, the operation of the second control section 6 varies the force acting on the heating belt 3. Thus, it is possible to control the contact pressure per unit area at the contact area between the heating belt 3 and the press roller 4. Normally, the magnitude of the contact pressure per unit area is determined according to the width of contact area between the heating belt 3 and the press roller 4 in consideration of the recording paper and operational environment. The magnitude of the contact pressure per unit area may be controlled according to the difference of the recording paper and operational environment in consideration of the width of contact area. In this case, it is necessary to uniformly maintain the fixing condition of the recording paper.

Figure 3:
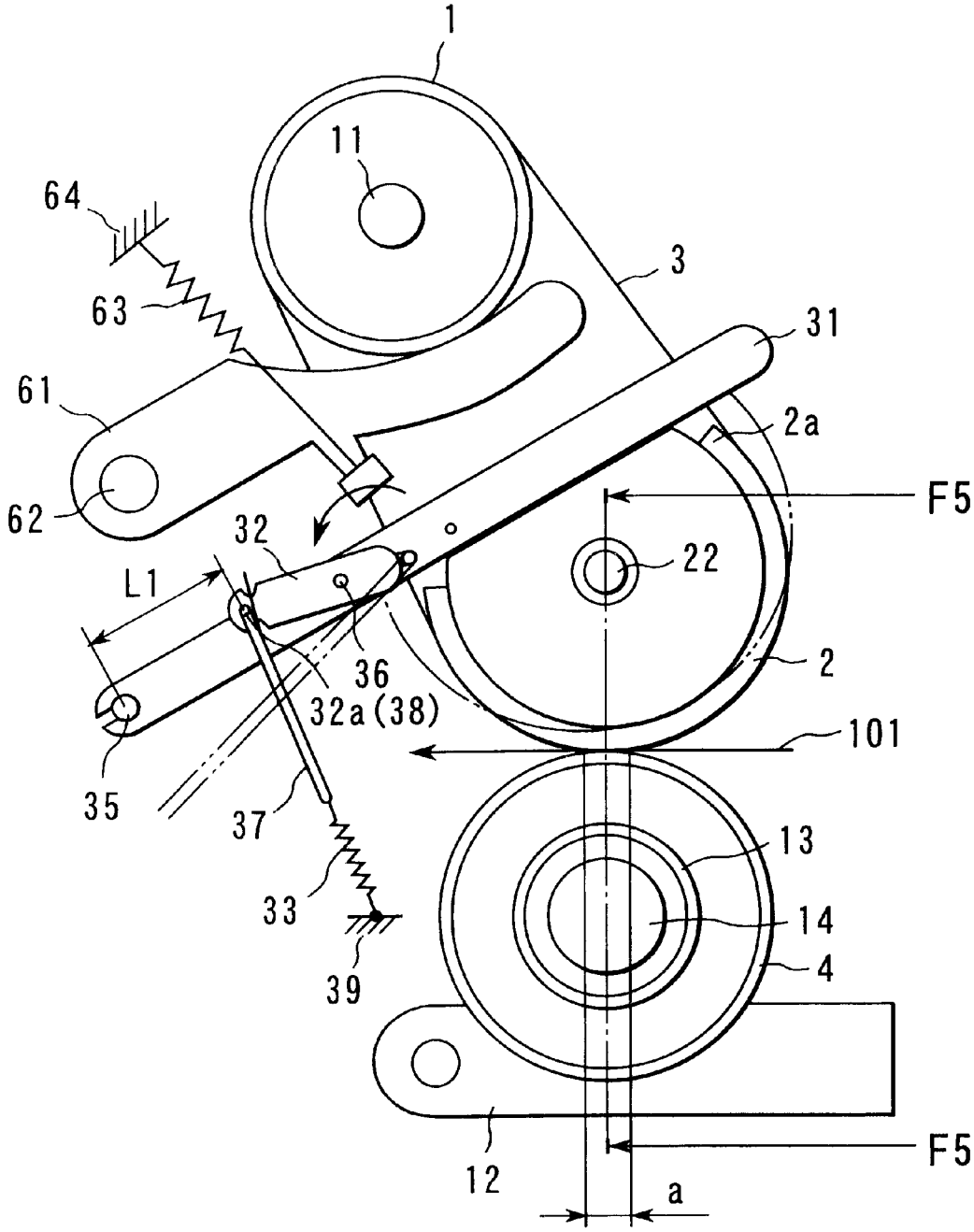
FIG. 3 is a side view showing a state of contact between a heating belt and a press roller in the fixing apparatus according to the embodiment.
Figure 4:
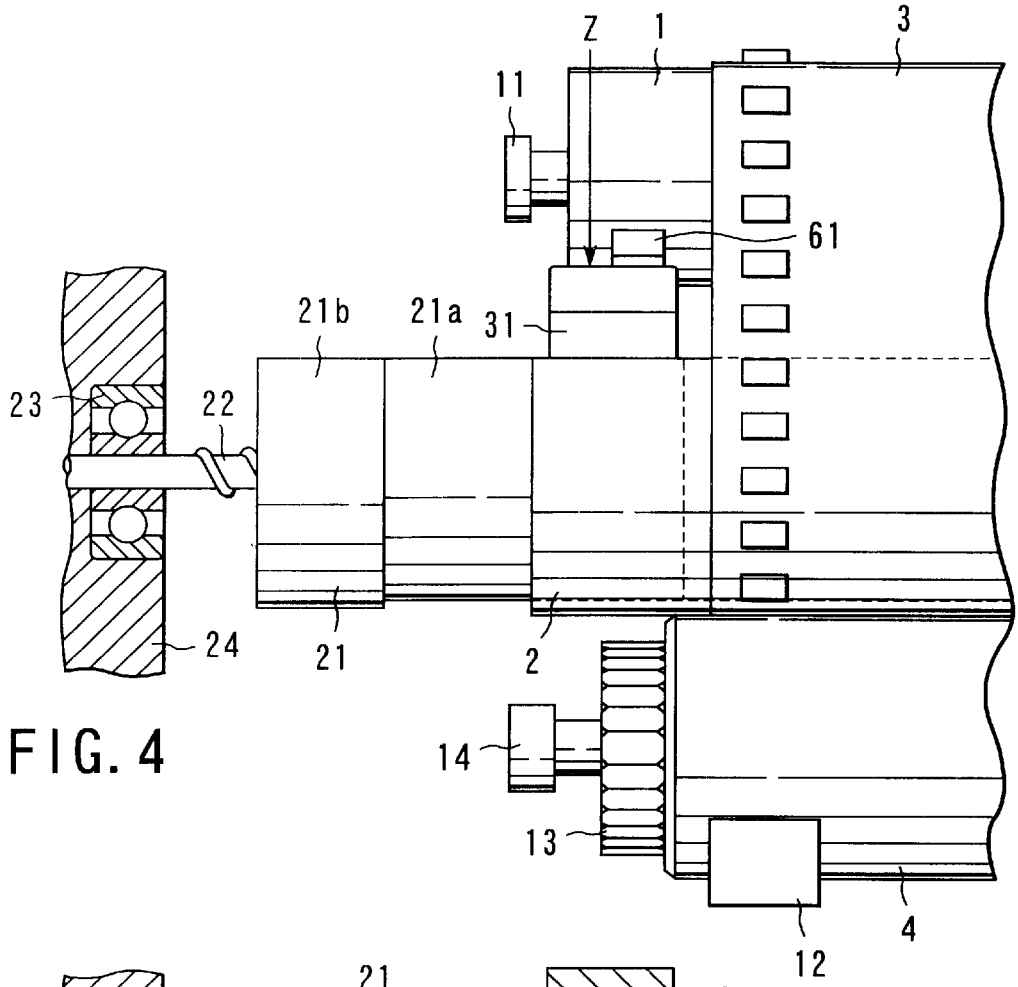
FIG. 4 is a front view showing a state of contact between the heating belt and the press roller in the fixing apparatus according to the embodiment.
Figure 5:
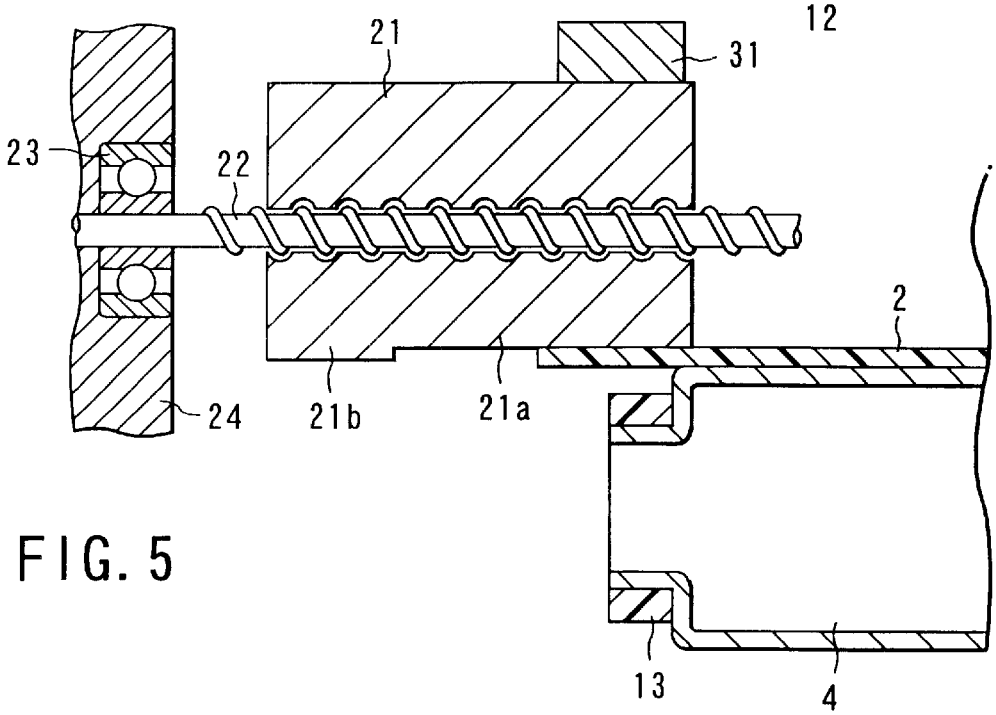
FIG. 5 is a cross sectional view taken along lines F5—F5 in FIG. 3.
Figure 6:
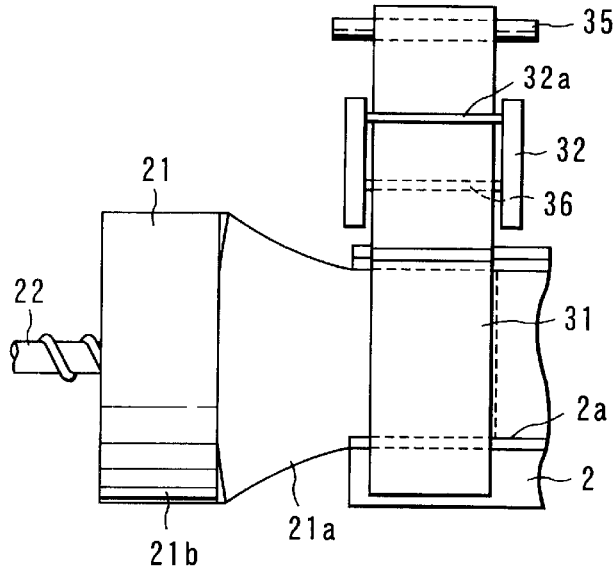
FIG. 6 shows a portion viewed from direction Z in FIG. 4.

For example, a normal case requires setting the width of the contact area between the heating belt 3 and the press roller 4 and the contact pressure per unit area thereof as shown in FIGS. 3, 10, and 11. When the recording paper 101 used is thicker than the normal case, the width of contact area is increased as shown in FIGS. 7, 12, and 13. Then, the second control section 6 operates to change the working point of the elastic member 33 and increase the force acting on the heating belt 3. The contact pressure of the elastic member 33 per unit area at the contact area between the heating belt 3 and the press roller 4 is controlled almost the same as that for the normal case. Hence, it is possible to uniformly maintain the fixing condition of the recording paper.

If necessary, it is possible to change a contact pressure per unit area at the contact area between the heating belt 3 and the press roller 4. For example, the recording paper can be heated sufficiently by increasing the contact pressure per unit area at the contact area between the heating belt 3 and the press roller 4. When a part touching the recording paper is not heated sufficiently.

The embodiment uses the cradle member 12 to maintain and support the press roller 4 at a specified height. Therefore, if a change is made to the width or the contact pressure of the contact area between the heating belt 3 and the press roller 4, it is possible to prevent the height position from varying by keeping the height position of the contact area in a vertical direction. Consequently, if the condition of the contact area between the heating belt 3 and the press roller 4 is changed, it is possible to prevent fluctuation of the conveying state of the recording paper or the fixing condition of toner images.

We conducted a test to compare the fixability of the fixing apparatus according to the present invention with that of a conventional fixing apparatus. The test was based on the same conditions for the electrophotographic apparatus except the fixing apparatus according to the present invention. The fixing apparatuses used the same configuration, materials, and fixing conditions except the new configuration according to the embodiment of the present invention. The same size of the external diameter was used for the belt support member of the fixing apparatus according to the present invention in the normal case and for the belt support roller of the conventional fixing apparatus.

The comparison between the fixing apparatuses was expressed by the comparison between fixabilities of toner images. For representing the fixing strength, a 25% half-tone pattern and a 100% solid pattern were printed at 600 dpi on the recording paper. The patterns were rubbed, in a fastness test, to determine fastness, and to measure the ratio (percentage) of the remaining toner image. For determining the offset properties, a print sample was fixed on the recording paper to check whether or not an offset occurs on the recording paper.

Figure 14:
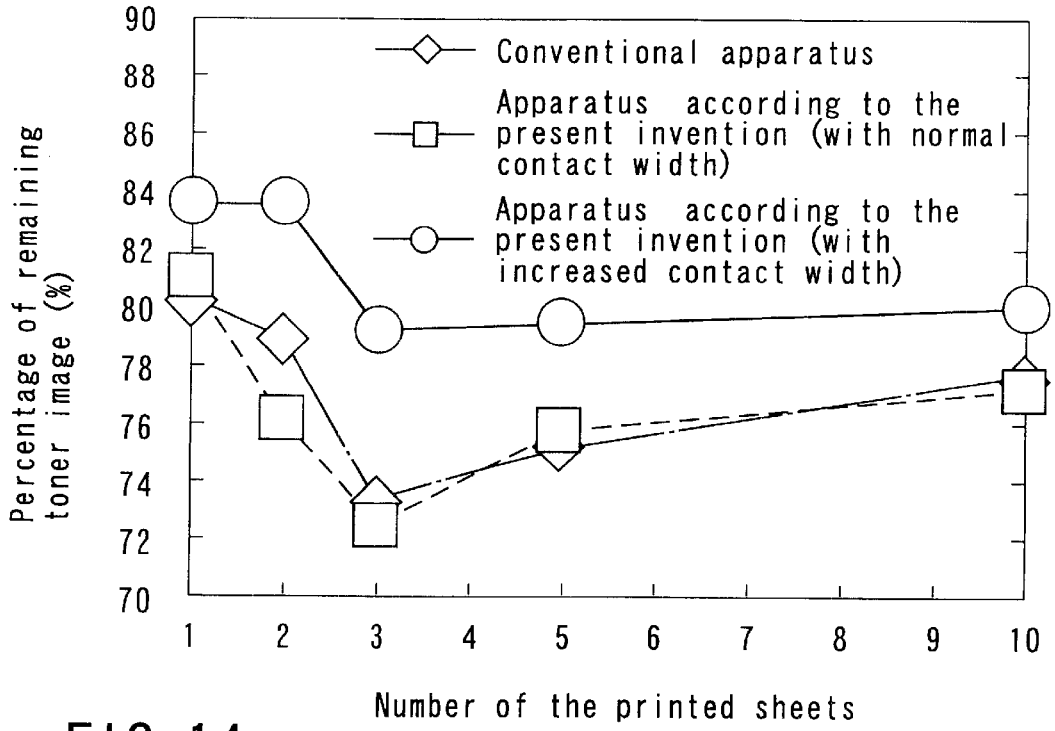
FIG. 14 is a chart comparing fixing results obtained by fixing apparatuses.
Figure 15:
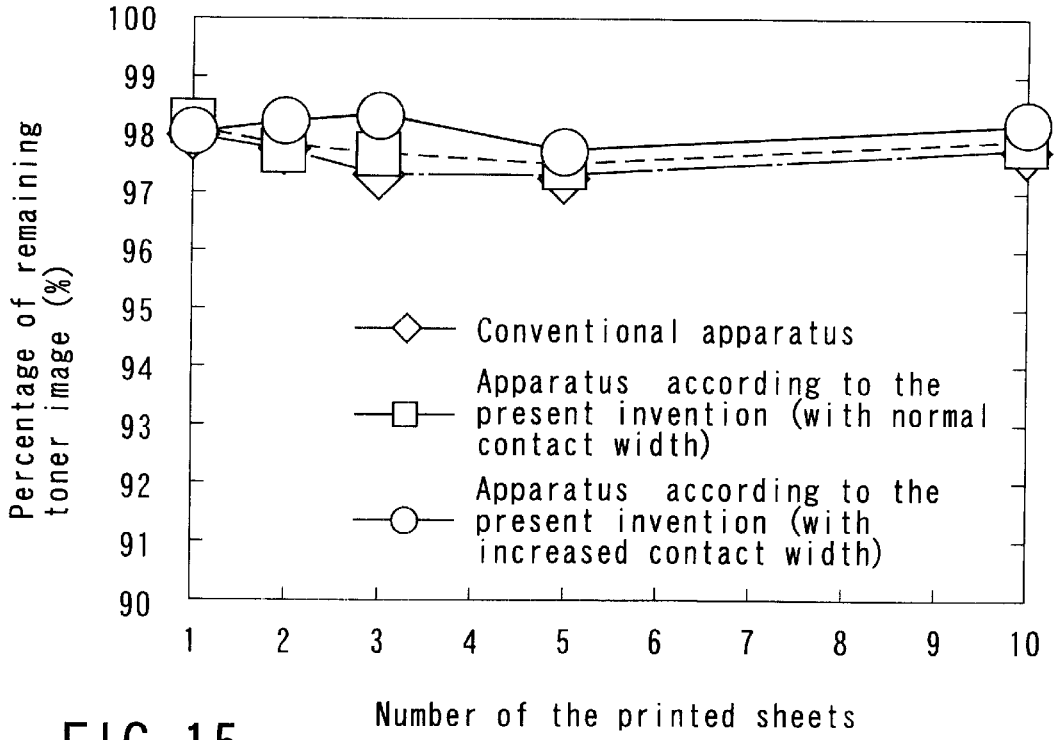
FIG. 15 is a chart comparing fixing results obtained by fixing apparatuses.

Charts in FIGS. 14 and 15 show ratio (percentages) of the remaining toner image with respect to the 25% half-tone pattern in FIG. 14 and the 100% solid pattern in FIG. 15. According to the charts, there is no difference between fixabilities for the fixing apparatus according to the present invention and the conventional fixing apparatus when the normal width is used for the contact area between the heating belt and the press roller. However, increasing that contact area width compared to the normal case for the fixing apparatus according to the present invention eliminated an offset that occurred in the conventional fixing apparatus and in the fixing apparatus according to the present invention having the normal contact area width. The fixability for the 25% half-tone pattern improved by 5%.

Then, we investigated an effect of a change in the width of the contact area between the heating belt and the press roller on conveying of the recording paper. More specifically, we examined three nonconformity cases: clogging (jamming) of the recording paper, bending of the recording paper at the end, and skewed conveying of the recording paper occurring in the fixing apparatus. These errors were measured by counting the number of nonconformity sheets of recording paper by continuously printing 1,000 sheets of paper. As measurement results, the conventional fixing apparatus having the normal contact area width produced two jammed sheets, four sheets with bent ends, and 20 skewed sheets during conveying. The fixing apparatus according to the present invention having the normal contact area width produced one jammed sheet, three sheets with bent ends, and 18 skewed sheets during conveying. The fixing apparatus according to the present invention having the increased contact area width produced two jammed sheets, four sheets with bent ends, and 19 skewed sheets during conveying.

According to the measurement results, the fixing apparatus according to the present invention revealed the same or a smaller rate of nonconformity occurrence than the conventional fixing apparatus irrespective of the width of the contact area between the heating belt and the press roller. Consequently, it was found that the conveying of the recording paper is not affected by changing the width of the contact area between the heating belt and the press roller in the fixing apparatus according to the present invention.

For comparison with the conventional fixing apparatus, the measurement results were obtained by making no change in the configurations, materials, and fixing conditions except the new configuration used for the fixing apparatus according to the present invention. It is possible to further decrease the above-mentioned nonconformities by modifying the configurations suitably.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An apparatus for fixing a toner image formed on a printout material, comprising:

a heating member which rotates around an axis;

a belt support member which is heat-resistant and elastic, has a cylindrical shape partly cut out along an axis line direction, and is capable of varying the size of a cross section area;

an endless heating belt which rotates by being supported by said heating member and said belt support member, and slidingly contacts said belt support member;

a press member which conveys said printout material by cooperating with part of said heating belt supported by said belt support member putting the printout material between them;

a first control section which supports said belt support member and controls the size of the cross section area thereof; and a second control section which applies a force to said heating belt toward said press member and controls said force.

2. The fixing apparatus according to claim 1, wherein said first control section has a control member which is provided so as to be capable of being moved in or out of the inside of said belt support member along the axis line direction and has a cross section area varying in the axis line direction.

3. The fixing apparatus according to claim 1, wherein said second control section includes a rotatable lever to press said first control section at a position opposite said press member, an elastic member to apply a force to the lever toward said press member, and a mechanism to move a position for the elastic member to apply a force to said lever.

4. The fixing apparatus according to claim 1, wherein said press member is kept at a given height.

5. The fixing apparatus according to claim 1, wherein said heating belt is given a tensile force.

6. The fixing apparatus according to claim 1, wherein said belt support member has a cross section shaped arc.

7. The fixing apparatus according to claim 1, further comprising a mechanism to apply releasing agent to a surface of said heating belt.

8. The fixing apparatus according to claim 1, further comprising a mechanism to supply lubricant between said heating belt and said belt support member.

* * * * *